United States Patent [19]

Scott et al.

[11] Patent Number: 4,846,964

[45] Date of Patent: Jul. 11, 1989

[54] FLUIDIZED-BED BIOREACTOR PROCESS FOR THE MICROBIAL SOLUBILIZTION OF COAL

[75] Inventors: Charles D. Scott, Oak Ridge; Gerald W. Strandberg, Farragut, both of Tenn.

[73] Assignee: The United States of America as represented by the United States Department of Energy, Washington, D.C.

[21] Appl. No.: 95,696

[22] Filed: Sep. 14, 1987

[51] Int. Cl.[4] ..... C10G 1/00

[52] U.S. Cl. ..... 208/428; 208/409; 210/627; 210/601; 210/622; 585/240

[58] Field of Search ..... 208/409, 428, 400, 153, 208/157, 13; 422/232; 505/240; 210/601, 616, 622, 627, 628, 620; 48/197 FM

[56] References Cited

U.S. PATENT DOCUMENTS

| | | | |
|---|---|---|---|
| 2,641,505 | 6/1953 | Sanderson | 208/425 X |
| 2,907,389 | 10/1959 | Hitzman | 208/428 X |
| 3,703,558 | 11/1972 | Levine | 208/157 X |
| 3,761,393 | 9/1973 | Wolk et al. | 208/157 X |
| 3,966,599 | 6/1970 | Burkhead | 210/628 X |
| 4,294,703 | 10/1981 | Wilms et al. | 210/627 X |
| 4,452,701 | 6/1984 | Garrett et al. | 210/627 |

*Primary Examiner*—Glenn Caldarola

*Attorney, Agent, or Firm*—Katherine P. Lovingood; Stephen D. Hamel; William R. Moser

[57] ABSTRACT

A fluidized-bed bioreactor system for the conversion of coal into microbially solubilized coal products. The fluidized-bed bioreactor continuously or periodically receives coal and bio-reactants and provides for the production of microbially solubilized coal products in an economical and efficient manner. An oxidation pre-treatment process for rendering coal uniformly and more readily susceptible to microbial solubilization may be employed with the fluidized-bed bioreactor.

11 Claims, 2 Drawing Sheets

FLUIDIZED-BED BIOREACTOR PROCESS FOR THE MICROBIAL SOLUBILIZTION OF COAL

BACKGROUND OF THE INVENTION

1. Field of the Invention

The present invention relates to a system, method and apparatus for the conversion of coal into liquid and gaseous products by microbiol solubilization. More specifically, the present invention relates to a fluidized-bed bioreactor system capable of continually and economically producing liquid and gaseous coal products by microbial solubilization.

2. Description of Related Art

Conventional, thermal and chemical processes for the conversion of coal to liquid and gaseous products generally require somewhat extreme temperature, pressure, and chemical conditions. The severity of the operating conditions may commonly include pressures in excess of 3000 psi and temperatures in excess of 800° F. These processes also usually require a significant capital investment. Because of the relatively mild operating conditions associated with many biological processes, there has been a recurring interest in the potential use of microorganisms for coal processing.

There have been earlier suggestions that microorganisms may be able to solubilize native coal. M. H. Rogoff et al, Microbiology of Coal, U.S. Bureau of Mines, Information Circular 8075 (1962); J. A. Korburger, 36 *Proc. W. Va. Acad. Sci.* 26 (1964). In recent experiments, certain strains of fungi have been shown to produce a liquid product when cultured on the surface of lignite coal in the presence of humid air. M. S. Cohen and P. O. Gabrielle, 44 *Appl. Environ. Microbiol.* 23 (1982); C. D. Scott, G. W. Strandberg, and Susan N. Lewis, 2 *Biotech. Progress,* 161 (1986). Although the scientific feasibility of microbial solubilization of coal is currently being established, up to this time it has not been reported that large-scale bioreactor concepts or continuous bioreactor production methods are feasible.

It has also been found that although a variety of fungal species have been shown to be able to form liquid products from coal, only one highly oxidized North Dakota lignite coal has been found to be susceptible to both rapid (1–3 days) and extensive liquefaction (about 80–90% of solids solubilized). Other coals and have been found to give sporatic evidence of limited liquefaction.

It is therefore desirable to scale-up laboratory techniques which employ suspension cultures of microorganisms that interact with coal into processes which provide for the microbial solubilization of coal in an efficient and economical manner. It is further desirable to carry out coal microbial conversion processes which allow for the continuous production of liquid and gaseous products at minimal costs.

It is still further desired to increase the susceptibility of lignite and subbituminous coals to microbial liquefaction and to reduce the time period required for microbial liquefaction.

SUMMARY OF THE INVENTION

Therefore, it is an object of the present invention to provide a fluidized-bed bioreactor system for the microbiol solubilization of coal.

It is a further object of the present invention to incorporate coal microbial solubilization concepts into large scale bioreactor systems that provide for biological and environmental conditions to produce liquid and gaseous coal products in an economical and efficient manner.

Another object of the present invention is to incorporate coal microbial solubilization concepts into bioreactor systems that provide for adequate solubilization reactant introduction and product removal on a continuous basis.

Still, a further object of the present invention is to provide a pretreatment process which renders lignite and subbituminous coals uniformly susceptible to fungal liquefaction.

Still, another object of the present invention is to provide a pretreatment process for coal which reduces the time period required for fungal liquefaction.

The foregoing objects and others are accomplished in accordance with the present invention, generally speaking, by employing a system, method, and apparatus for continually producing liquid and gaseous coal products by microbial solubilization in a fluidized-bed bioreactor which includes a bioreactor container for containing coal, bio-reactants, and an upflowing aqueous recycling stream of fluidized particulates; an aerator for maintaining adequate aeration in the bioreactor container; a settling chamber operatively associated with the bioreactor container which continuously receives the aqueous recycling stream from the bioreactor container and separates solid residue from the stream; a product collecting device operatively associated with the bioreactor container which continuously collects liquid product from the aqueous recycling stream; and a pump operatively associated with the bioreactor container collecting device which pumps the aqueous recycling stream through the bioreactor container, the settling chamber, and the product collection device so as to recycle the stream. The method for operating this bioreactor system may include the introduction of a chemical, such as a polyelectrolyte, which induces the attachment of microorganisms to the coal particles.

The present invention may also be generally described as including an oxidation pretreatment process for rendering coal uniformly and more readily susceptible to microbial solubilization.

The present invention allows for large scale production of coal microbial solubilization products in a continuous and economical manner.

The present invention also encompasses a second bioreactor system apparatus which includes a bioreactor container for containing coal, bio-reactants, and an upflowing aqueous recycling stream suitable for microbial solubilization; a liquid reservoir operatively associated with the bioreactor container; an aerator operatively associated with the liquid reservoir for maintaining adequate aeration; and a pump operatively associated with the bioreactor container and the liquid reservoir which recycles the aqueous recycling stream.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
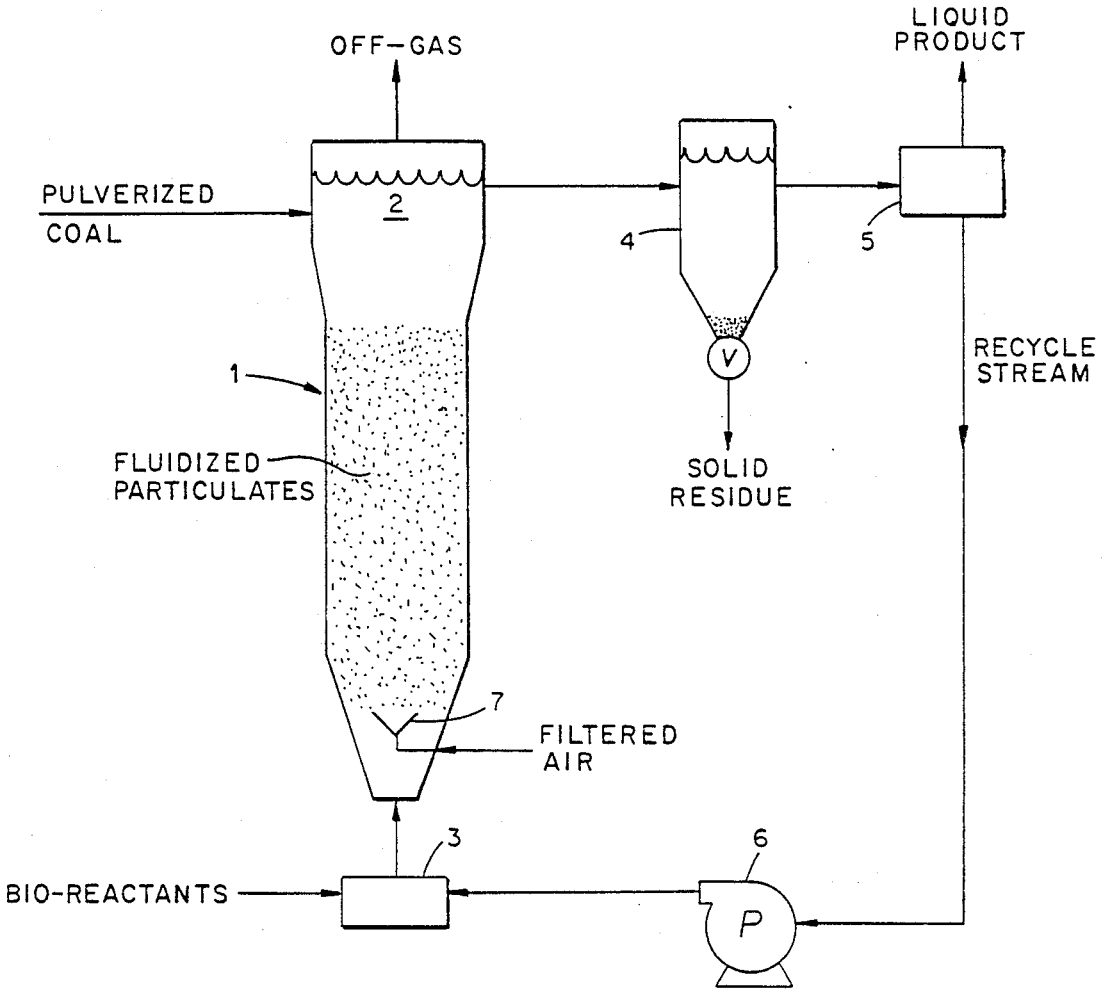
FIG. 1 is a schematic representation of a preferred embodiment of a fluidized-bed bioreactor system according to the present invention.

Referring in detail to FIG. 1, there is illustrated a bioreactor container generally indicated which includes an aerator. Coal particles, such as pulverized coal, may be introduced at the upper portion 2 of the bioreactor container 1, while bio-reactants may be introduced at the lower portion 3 of the bioreactor container. The settling chamber 4, operatively associated with the bioreactor container 1, receives an aqueous recycling stream from which solid residue is removed. A product collecting device 5 receives the aqueous recycling stream so that liquid product may be removed and collected. The aqueous recycling stream is then pumped by a pump 6 so that it is recycled into the bioreactor container 1 for further use in the bioreactor system. Flow arrows indicate flow directions.

Figure 2:
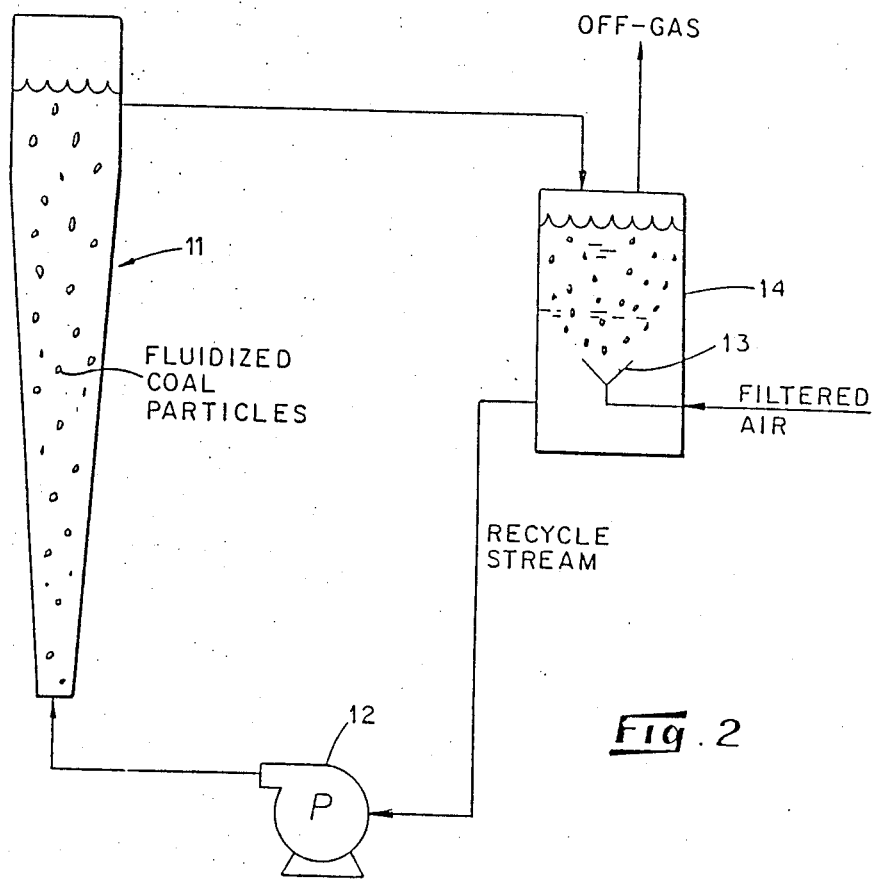
FIG. 2 is a schematic representation of a second preferred embodiment of a fluidized-bed bioreactor system according to the present invention that is especially useful for studying microbial attachment to coal particles.

Referring in detail to FIG. 2, there is illustrated a fluidized-bed bioreactor system, especially useful for studying the attachment of microorganisms to coal particles, which includes a bioreactor container 11, which contains fluidized or suspended coal particles, bio-reactants and an upflowing aqueous recycling stream and which provides for the microbial solubilization of coal. An aerator 13 maintains adequate aeration in a liquid reservoir 14 which is operatively associated with the bioreactor container 11 and through which the aqueous recycling stream flows. A pump 12 pumps the aqueous recycling stream between the liquid reservoir 14 and the bioreactor container 11. Flow arrows indicate flow directions.

DETAILED DESCRIPTION OF THE PREFERRED EMBODIMENTS

According to a first preferred embodiment of the present invention and with reference to FIG. 1, coal particles, such as pulverized coal, are introduced continuously or periodically into an upper portion 2 of a bioreactor container generally indicated 1. The bioreactor container, which may be in the form of a column, is capable of containing coal particles, bio-reactants, and an upflowing aqueous recycling stream with fluidized particulates. The bioreactor container is adapted to be operatively associated with a device that maintains adequate aeration in the bioreactor container, such as aerator 7. The upper portion 2 of the bioreactor container 1 is capable of receiving coal particles continuously or periodically, while the lower portion 3 is capable of receiving bio-reactants with the upflowing aqueous recycling stream for introduction into the container. The bioreactor container is adapted for the removal of off-gas. Further, the bioreactor container is operatively associated with a pumping devices such as pump 6, and other product and by-product removal devices, such as a settling chamber 4 and a product collecting device 5, so as to allow the aqueous recycling stream to flow through these devices and recycle into the bioreactor container. The bioreactor container of the present invention may be in the form of a column or other forms known to those skilled in the art.

The settling chamber 4 is operatively associated with the bioreactor container and is capable of removing solid residue or unreacted particulates such as, for example, by allowing solid residue to settle out from the aqueous recycling stream. The settling chamber may include a dispensing valve and may be in the form of a column or other forms known to those skilled in the art.

The product collecting device 5 is operatively associated with the bioreactor container and may be, for example, operatively connected to the settling chamber 4. The product collecting device receives the aqueous recycling stream for the purposes of removing liquid product from the stream which results from the coal microbial solubilization process. The product collecting device also recycles the aqueous recycling stream to the bioreactor container. Suitable product collecting devices include a sedimentation chamber, a continuous filter, or a continuous centrifuge.

A pump 6 is operatively associated with the bioreactor container and may be, for example, operatively connected to a product collecting device. The pump receives the aqueous recycling stream from the bioreactor container or, for example, from the product collecting device 5 and pumps the stream through the bioreactor system. A pump appropriate for the size of the desired bioreactor system is used.

The coal particles, or pulverized coal, used in the microbial solubilization process of the present invention, may be lignite, subbituminous or other preoxidized coals. Specific examples include Mississippi lignite, Texas lignite, Vermont lignite, North Dakota lignite and Wyoming-Dakota subbituminous coal. According to the present invention, the coal particles are in the particle size range of 10 to 100 mesh, and preferably in the particle size range of 30 to 60 mesh.

The bio-reactants used according to the present invention include microorganisms and nutrients. The microorganisms are capable of microbially solubilizing coal and include, for example, various fungal and bacterial species. Specific examples include *Trametes versicolor, Poria placenta, Penicillium waksmanii* ML20, *Candida* sp. ML13, *Aspergillus* sp., *Paecilomyces* sp., *Sporothrix* sp., *Streptomyces setonii,* and *Streptomyces viridosporous.* Sources for these microorganisms are indicated in Table 1.

TABLE 1

| Microorganism | Source |
|---|---|
| *Trametes versicolor* ATCC 12679 | Obtained from ATCC* |
| *Poria placenta* (monticola) ATCC 13538 | Obtained from ATCC |
| *Penicillium waksmanii* ML20 | Obtained from H. B. Ward, who isolated these organisms from Mississippi lignites[1] |
| Candida sp. ML13 | Obtained from H. B. Ward, who isolated these organisms from Mississippi lignites |
| Aspergillus sp. | Isolated from an as-received lignite sample |

TABLE 1-continued

| Microorganism | Source |
|---|---|
| Paecilomyces sp. | Isolated from an as-received lignite sample |
| Sporothrix sp. | Isolated from an as-received lignite sample |
| *Streptomyces setonii* ATCC 39116 | Obtained from ATCC |
| *Streptomyces viridosporous* | Obtained from D. L. Crawford, University of Idaho, Moscow, ID |

*American Type Culture Collection
[1]H. B. Ward, "Apparent Bioliquefaction of Lignite by Fungi and Their Growth on Lignite Components", Bioenergy 84 (June 18-21, 1984).

The nutrients which are combined with the microorganisms in the present bioreactor system, are capable of suitably fostering microbial growth so as to allow for desired microbial solubilization of coal to occur. Suitable nutrients include Sabouraund maltose, modified Czapek-Dox medium, and defined media.

The aerator 7 used in the preferred embodiments of the present bioreactor system maintains adequate aeration in the bioreactor container, for example in the form of oxygen gas or filtered air, so as to allow for the microbial solubilization of coal.

The aqueous recycling stream utilized in the present bioreactor system is capable of sustaining microbial solubilization and may include a dilute concentration of mineral salts.

A chemical, such as a polyelectrolyte, or material, such as cheese whey, may be introduced into the bioreactor system of the present invention in order to induce attachment of the microorganisms to the coal particles so as to enhance the microbial solubilization process.

In a second preferred embodiment of a fluidized-bed reactor system according to the present invention, with reference to FIG. 2, a bioreactor container 11 is provided which contains coal, bio-reactants, and an upflowing aqueous recycling stream. The bioreactor container 11 is suitable for continuously or periodically receiving coal particles. The bioreactor container is adapted to as to be capable of receiving coal particles continuously or periodically. The bioreactor container is also operatively associated with a liquid reservoir 14 and a pump 12 so as to allow the aqueous recycling stream to be recycled through the bioreactor container 11. The bioreactor container provides a means for studying microbial attachment of microorganisms to coal particles and may be in the form of a column. One example of a suitable bioreactor container is a tapered column that is 15 cm long.

The liquid reservoir 14 is suitable for containing the aqueous recycling stream and is provided with an aerator 13. The liquid reservoir is constructed so as to allow for the addition of bio-reactants into the bioreactor system.

The pump 12 pumps the aqueous recycling stream between the liquid reservoir 14 and the bioreactor container 11.

An oxidation pretreatment process is also encompassed by the present invention. The oxidation pretreatment process comprises reacting coal with an oxidizing agent so as to render the coal uniformly and more readily susceptible to microbial solubilization, such as, for example, fungal liquefaction. Suitable oxidizing agents include, for example, hydrogen peroxide, nitric acid, and ozone. During the oxidation pretreatment process, the coal is exposed to the oxidizing agent by, for example, immersing the coal in an oxidizing agent solution or exposing the coal to an oxidizing agent gas. The coal may require sterilization after pretreatment and before exposure to microbial solubilization. Other oxidation pretreatment conditions can be determined by one of ordinary skill in the art. The oxidation pretreatment process may be used in conjunction with the fluidized-bed bioreactor system according to the present invention.

In order to further define the specifics of the present invention, the following examples are provided and are intended to illustrate the fluidized-bed bioreactor concepts of the present invention and not limit the particulars of the present invention:

EXAMPLES

EXAMPLE 1

Mississippi lignite, in the particle size range of 30 to 60 mesh, is introduced into a tapered fludized-bed column that is 15 cm long and is analogous to the bioreactor container 11 of FIG. 2. The coal bed of approximately 30 milliliters is fluidized by pumping an aqueous upflowing dilute mineral salts solution stream through the fluidized-bed column. The aqueous stream is aerated in a liquid reservoir analogous to the liquid reservoir 14. This fluidized-bed bioreactor system is inoculated with the fungi Candida sp. ML13 and a small amount of cheese whey (approximately 0.05 percent) is added to enhance microbial attachment. The fungi is found to produce prolific growth and the coal particles become completely coated with biomass in a short period of time. The amount of dissolved material increases with time which indicates that the solubilization of coal is proceeding. This bioreactor system operates on the same principles as the fluidized-bed bioreactor system described above and represented in FIG. 1.

EXAMPLE 2

Highly oxidized North Dakota lignite or nitric acid-treated Wyodak subbituminous coal in the particle size range of 30 to 60 mesh in two separate tests was added to 250-ml shake flasks in which *Streptomyces setonii* was growing in a Sabouraud Maltose broth at 30 degrees Celcius. In both cases, solubilization of the coal was initiated within three hours with as much as 81 percent of the coal being solubilized after two days. The aggitation within the flasks was by a rotary motion at 100 rpm with a 2-in stroke. This resulted in suspension of the coal particles much as they would be in a fluidized bed.

The following examples illustrate oxidation pretreatment processes which may be employed in conjunction with the fluidized-bed bioreactor system according to the present invention and are not intended to limit the particulars of the present invention:

EXAMPLE 3

A few grams of lignite coal specimens are selected from Mississippi, Texas, Vermont and North Dakota lignites and are size-reduced to 20-30 mesh. Each specimen is pretreated by soaking in 10 percent hydrogen peroxide for one week and then drying the specimen. The pretreated lignites are placed on the surface of a fungal mat of either Candida sp. ML13 or *Trametes versicolor* ATCC 12679 along with a portion of lignite that is not pretreated for comparison. The specimens are incubated at approximately 30 degrees Celsius and observed for liquefaction. Within 1–3 days, the pretreated coal is observed to be liquifying while the coal that is not pretreated shows little or no signs of liquefaction.

EXAMPLE 4

About 0.5 grams of Mississippi lignite is exposed to an ozone atmosphere for a period of about 2 hours. The pretreated specimen during a pretreatment process is placed on a fungal mat of Candida sp. ML13 along with a portion of lignite that is not pretreated for comparison. Within 1–3 days, the pretreated coal specimen is observed to be liquifying while the specimen that is not pretreated shows little sign of activity. Approximately 0.3 ml of liquid product is recovered over several days from the pretreated coal specimen. In contrast, the specimen that is not pretreated produces less than 20 microliters.

EXAMPLE 5

One to four grams of Mississippi, Texas and Vermont lignites and a Wyoming-Dakota, or Wyodak, subbituminous coal are subjected to pretreatment with 10 percent, 20 percent, or 30 percent (w/v) hydrogen peroxide or 5 M or 8 M nitric acid. Small portions (0.1–0.9 g) are removed after 1, 2 and 3 days; rinsed with distilled water; oven dried (90 degrees Celsius, 18 hours) and then are exposed to a culture of Candida sp. ML13. When observed on the third day following the initial exposure to the culture, all samples show significant liquefaction. Estimates of the degree of liquefaction for the various pretreated coals range from approximately 15 to 90 percent based on dry weight loss of coal. Significant amounts of liquid product are recovered from all pretreated coal samples, e.g. several tenths of a milliliter or more. This is in contrast to little (less than 50 microliters of product) or no liquefaction routinely observed with the coal samples that are not pretreated.

EXAMPLE 6

Approximately 0.3 g of Mississippi, Texas and Vermont lignites and a Wyodak subbituminous coal are exposed to a flowing stream of ozone (approximately 1–2 percent by weight, 200 cc/min dry oxygen) for 0.5, 1.0, 1.5 or 2.0 hours during a pretreatment process. The samples are oven dried (90 degrees Celsius, 18 hours) prior to exposure to a culture of Candida sp. ML13. All the pretreated lignite coals show evidence of liquefaction within 24 hours. The Wyodak subbituminous coal samples pretreated for 0.5 and 1.0 hours show no visible liquid product but evidence some degree of liquefaction due to the appearance of a black substance that is diffusible into the agar medium. The Wyodak coal samples pretreated for 1.5 and 2.0 hours show the formation of a significant amount of liquid product.

EXAMPLE 7

Samples of Mississippi, Texas, Vermont and powdered North Dakota lignites and a Wyodak subbituminous coal are soaked in 10 M nitric acid for 3 days during the pretreatment process, rinsed well with distilled water, and then are exposed to either Candida sp. ML13, *Penicillium waksmanii* ML20 or *Trametes versicolor* ATCC 12679. All pretreated coal samples show substantial liquefaction, e.g. approximately greater than 75 percent dry weight loss of coal, and the formation of several tenths of a milliliter of liquid product over a period of two weeks.

Note that the coal samples in Examples 5 and 6 are sterilized by autoclaving (121 degrees Celsius, 15 psi, 45 min.) prior to exposure to cultures.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

What is claimed is:

1. A process for microbial solubilization of coal to liquid and gaseous products which comprises:

in an oxidizing environment, introducing coal particles continuously or periodically into a bioreactor container means, said bioreactor container means receiving an upflowing aqueous recycling stream which fluidizes said particles, introducing microorganisms and nutrients continuously or periodically into said bioreactor container means so as to allow for microbial solubilization of coal, and removing liquid product and solid residue from said bioreactor container means with said aqueous recycling stream.

2. A process according to claim 1, wherein the coal particles are introduced into the bioreactor container means with first introduction means and wherein the bio-reactants are introduced into said microorganisms and nutrients container means with second introduction means and which additionally comprises:

maintaining aeration in said bioreactor container means with aerator means, separating said solid residue from said aqueous recycling stream with a settling chamber means operatively associated with said bioreactor container means, collecting said liquid product from said aqueous recycling stream with collecting means operatively associated with said settling chamber means, and pumping said aqueous recycling stream through said bioreactor container means, said settling chamber means, and said collecting means with pump means operatively associated with said bioreactor container means so as to recycle said aqueous recycling stream.

3. The process according to claim 1, wherein a polyelectrolyte is introduced into said bioreactor container so as to induce attachment of the microorganisms to the coal particles.

4. The process according to claim 1, wherein the microorganisms are selected from the group consisting of *Trametes versicolor. Poria placenta, Penicillium waksmanii* ML20, Candida sp. ML13, Asoeroillus sp., Paecilomyces sp., Sporothrix sp., *Streptomyces setonii,* and *Streptomyces viridosoorous* T7A.

5. The process according to claim 4, wherein the microorganisms are Candida sp. ML13 and wherein the aqueous recycling stream includes a mineral salts solution.

6. The process according to claim 1, wherein the coal is lignite or subbituminous coal.

7. The process according to claim 1, wherein the coal is selected from the group consisting of Mississippi lignite, Texas lignite, Vermont lignite, North Dakota lignite, and Wyoming-Dakota subbituminous coal.

8. The process according to claim 1, wherein prior to introducing the coal and the bio-reactants into the bioreactor container means, said coal is subjected to an oxidation pretreatment process which comprises:

reacting said coal with an oxidizing agent so as to render said coal uniformly and more readily susceptible to microbial liquefaction.

9. The process according to claim 8, wherein the coal is lignite or subbituminous coal and wherein said coal is rendered uniformly and more readily susceptible to microbial liquefaction.

10. The process according to claim 8, wherein the coal is selected from the group consisting of Mississippi lignite, Texas lignite, Vermont lignite, North Dakota lignite, and Wyoming-Dakota subbituminous coal.

11. A process according to claim 8, wherein the oxidizing agent is selected from the group consisting of hydrogen peroxide, nitric acid, and ozone.

* * * * *